US005526947A

United States Patent [19]

Stolz

[11] Patent Number: 5,526,947

[45] Date of Patent: Jun. 18, 1996

[54] CLOSURE FOR A CONTAINER CONSISTING OF A LOWER CLOSURE PART AND A SCREW TOP

[75] Inventor: Bernd Stolz, Neunkirchen, Germany

[73] Assignee: Heinrich Stolz GmbH & Co. KG, Germany

[21] Appl. No.: 368,472

[22] Filed: Apr. 4, 1995

[30] Foreign Application Priority Data

Apr. 8, 1994 [DE] Germany ..... 44 12 195.4

[51] Int. Cl.[6] ..... B65D 55/02

[52] U.S. Cl. ..... 215/213; 215/216; 215/218; 215/330; 229/125.15

[58] Field of Search ..... 229/125.15; 220/601; 215/31, 330, 216, 208, 213, 218

[56] References Cited

U.S. PATENT DOCUMENTS

| | | | |
|---|---|---|---|
| 3,101,856 | 8/1963 | Whiteman, Jr. | 215/209 |
| 3,623,622 | 11/1971 | Sullivan | 215/213 |
| 3,941,268 | 3/1976 | Owens et al. | 215/218 X |
| 3,984,021 | 10/1976 | Uhlig | 215/217 X |
| 4,456,136 | 6/1984 | Palsson | 215/209 X |
| 5,078,288 | 1/1992 | Fuchs | 215/216 X |

FOREIGN PATENT DOCUMENTS

| | | |
|---|---|---|
| 264152 | 4/1988 | European Pat. Off. . |
| 2676997 | 12/1992 | France . |
| 3625477 | 2/1988 | Germany . |
| 4139896 | 6/1993 | Germany . |
| 4209784 | 1/1994 | Germany . |

*Primary Examiner*—Allan N. Shoap
*Assistant Examiner*—Robin A. Hylton
*Attorney, Agent, or Firm*—Speckman, Pauley & Fejer

[57] ABSTRACT

A closure for a container, comprising a lower closure part and a screw cap. The lower closure part has a pouring spout and can be connected with a container opening by a base element. The screw cap comprises a cap bottom and a cap shell having an interior thread. The screw cap can be screw-fastened and unfastened from the pouring spout, which is provided with an exterior thread. The screw cap is secured against being unfastened by engaged connections. The screw cap can be released for being unfastened by releasing the engaged connections. A child safety device is provided by a special design of the engaged connections between the screw cap and the lower closure part, so the body of the container is no longer a part of the child safety device and therefore can be optimally adjusted to its specific function.

8 Claims, 1 Drawing Sheet

CLOSURE FOR A CONTAINER CONSISTING OF A LOWER CLOSURE PART AND A SCREW TOP

BACKGROUND OF THE INVENTION

FIELD OF THE INVENTION

This invention relates to a closure for a container, comprising a lower closure part and a screw cap, wherein the lower closure part can be connected to a container opening by a base element. The closure has a pouring spout with external threads, on which the screw cap comprising a cap bottom and cap shell having interior threads can be screw-fastened and unfastened. When fastened, the screw cap is secured against being unfastened by engaged connections. The screw cap can be unfastened by releasing the engaged connections.

DESCRIPTION OF PRIOR ART

A closure of this type is known from Geoart Patent DE 42 09 784 C2. In this known closure, an engaged connection is formed between the screw top and the body. To achieve this, the front face of the screw cap is provided with circumferential engagement receivers which are engaged by engagement cams formed on the body of a lower closure part, It is necessary to compress the body to release the engaged connections, so that the engagement cams are radially displaced inwardly and moved out of the engagement receivers in the cap shell. This displacement of the body requires a considerable effort, particularly when a thick closure for a large container is involved.

SUMMARY OF THE INVENTION

It is one object of this invention to provide a closure for a container comprising engaged connections that can be easily released without losing their function as a child safety device.

This object is achieved in accordance with the closure of this invention comprising a screw cap having a cap shell which terminates in at least one engagement flap in an area of a free front face of the screw cap. An annular flange, which projects in the direction of the cap shell and partially covers the engagement flap is formed on the closure in a transition area toward the pouring spout. The annular flange is provided with engagement cams on its inside facing the engagement flap, which have a shallow rising flank in the direction of screw-fastening. The shallow rising flanks make a transition into steep engagement flanks and form engaged connections with the engagement flaps of the screw cap. The engaged connection can be released by a radial displacement of the engagement flaps.

The engagement flaps can be pushed inward by grasping and compressing the screw cap, which causes the engaged connection with the engagement cams on the inside of the annular flange to be released. Thus, the engagement flaps of the screw cap pass by the engagement flanks of the engagement cams, and the screw cap can be unscrewed from the pouring spout. The positions of the engagement flaps can be easily recognized so that it is not difficult for an adult to release the child safety device. The operation of the closure is not hampered by the additional annular flange on the lower closure part, in contrast to conventional closures with the engagement cams on the body.

In a preferred embodiment of this invention, two engagement flaps are disposed diametrically on the cap shell and an engagement cam is associated with each engagement flap on the lower closure part. Both engaged connections are simultaneously released by pressing together the lower area of the cap shell when the screw cap is grasped at the engagement flaps. The screw cap grasped and compressed in this way can then be simultaneously unscrewed from the pouring spout.

In accordance with another preferred embodiment of this invention, the pouring spout makes a transition via a shoulder into the body of the lower closure part. The annular flange at the shoulder is formed concentrically with respect to the pouring spout and together with the pouring spout forms an annular receptacle for the engagement flaps of the screw cap.

In another preferred embodiment, the engagement flaps have thin walls that extend over a portion of the circumference of the cap shell and can be easily displaced radially. Thus, a greater surface area for grasping the screw cap is achieved.

The invention will be described in detail by reference to preferred embodiments shown in the drawings.

DESCRIPTION OF PREFERRED EMBODIMENTS

Figure 1:
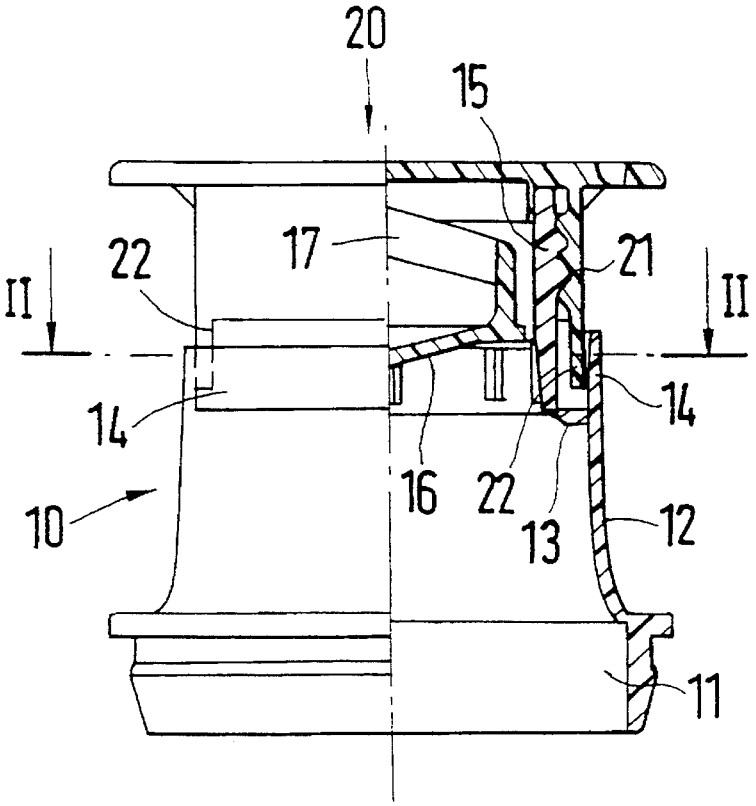
FIG. 1 shows a partial cross-sectional view of a closure according to one embodiment of this invention, in the secured closed position.

The closure, according to one embodiment of this invention, comprises a lower closure part 10 comprising a base element 11, a body 12 and a pouring spout 15. The base element 11 can be engaged in a container opening. The body 12 is extended in FIG. 1. The pouring spout 15 has an exterior thread, and a screw cap 20 provided with an interior thread can be fastened or unfastened from the pouring spout 15. The screw cap 20 has the interior thread on the inside of a cap shell 21. In the delivered state, the pouring spout 15 is closed by a seal plate 16. The seal plate 16 can be torn from the pouring spout 15 by a gripping tongue 17.

Figure 2:
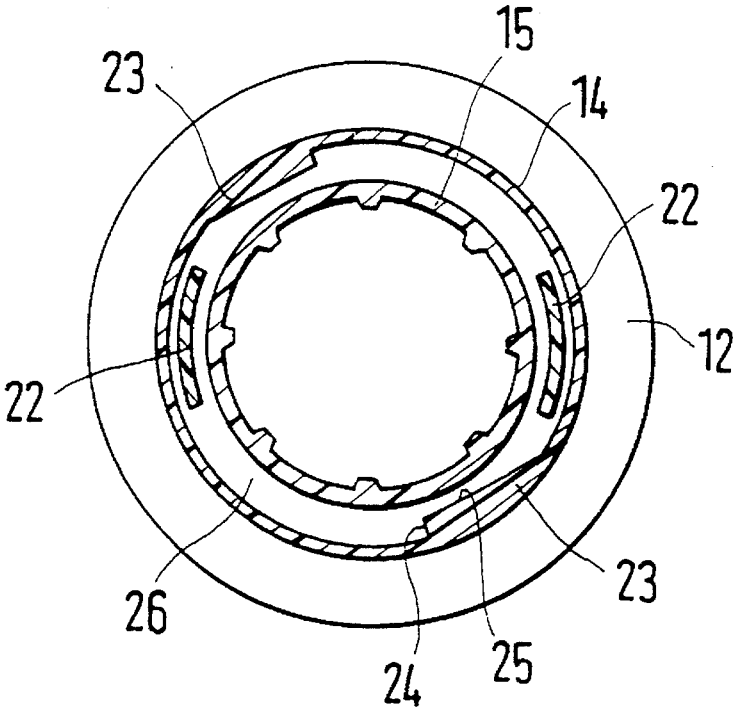
FIG. 2 shows a cross-sectional view of a closure according to one embodiment of this invention along the line II—II of FIG. 1.

At a free front face, the cap shell 21 of the screw cap 20 terminates in two engagement flaps 22 located diametrically opposite each other and extending over a part of the circumference of the screw cap 20, as shown in FIG. 2. A shoulder 13 is positioned at a transition from the pouring spout 15 to the body 12. An annular flange 14 extending toward a cap bottom of the screw cap 20 is formed on the shoulder 13, and together with the pouring spout 15 forms a receiving space 26 for the engagement flaps 22 when the screw cap 20 is screwed on the pouring spout 15. On an internal surface facing the engagement flaps 22, the annular flange 14 has engagement cams 23 which have shallow rising flanks 25 in the screw-fastening direction. The shallow rising flanks 25 make a transition into steep engagement flanks 24, the backs of which are engaged by the engagement flaps 22 of the screw cap 20. The annular flange 14 partially covers the engagement flaps 22, so that a portion of the engagement flaps 22 is still visible, and in this way marks the starting points for grasping the screw cap 20.

If the screw cap 20 is grasped in the area of the engagement flaps 22 and compressed, the engagement flaps 22 are brought out of engagement with the engagement cams 23 on the annular flange 14. The screw cap 20 can then be unscrewed from the pouring spout 15.

When screw-fastening the screw cap 20 on the pouring spout 15, the engagement flaps 22 slide over the shallow rising flanks 25 of the engagement cams 23 on the annular flange 14, but during unscrewing they push against the steep engagement flanks 24 of the engagement cams 23.

Normally a single engaged connection suffices as a child safety device. However, the two diametrically positioned engaged connections increase safety and make it easier for adults to release the child safety device.

A closure with a resiliently extendible body 12 in accordance with one preferred embodiment of this invention is illustrated in FIGS. 1 and 2. However, it is apparent that the child safety device can be used with any arbitrary closure. In another preferred embodiment, the annular flange 14 is positioned directly on the container. In yet another preferred embodiment, the annular flange 14 is positioned directly on the lower closure part 10.

I claim:

1. In a closure for a container having a lower closure part and a screw cap, the lower closure part having a pouring spout and being connectable to a container opening by a base element, the screw top having a cap bottom and a cap shell with an interior thread screw fastenable and unfastenable from the pouring spout having an exterior thread, the screw cap, when screw-fastened on the pouring spout, being secured against unscrewing by at least one engaged connection and the screw cap being unscrewable by releasing the at least one engaged connection, the improvement comprising:

at least one engagement flap (22) extending from the cap shell (21) of the screw cap (20) in the area of a free front face of said screw cap (20), an annular flange (14) projecting in a direction toward the cap bottom and at least partially covering the at least one engagement flap (22), said annular flange (14) formed on the lower closure part in a transition area toward the pouring spout (15), and the annular flange (14) comprising at least one engagement cam (23) on its inside facing the at least one engagement flap (22), said at least one engagement cam having a shallow rising Zlank (24) in the direction of screwing on of said screw cap (20), which makes a transition into at least one steep engagement flank (25) and forms at least one engaged connection with the at least one engagement flap (22) of the screw cap (20) which is released by an inward radial displacement of the at least one engagement flap (22) by a radial force applied tO the at least one engagement flap (22).

2. In a closure in accordance with claim 1, wherein the pouring spout (15) is connected to the base element (11) of the lower closure part (10) by an elastically extendible body (12), and the annular flange (14) is disposed in the transition area between the pouring spout (15) and the elastically extendible body (12).

3. In a closure in accordance with claim 2, wherein two engagement flaps (22) are disposed diametrically on the cap shell (21), and one said engagement cam (23) is associated with each said engagement flap (22) on the lower closure part (10).

4. In a closure in accordance with claim 3, wherein the pouring spout (15) makes a transition through a shoulder (13) into the elastically extendible body (12), and the annular flange (14) at the shoulder (13) is formed concentrically in respect to the pouring spout (15) and with said pouring spout (15) forms an annular receptacle (26) for the engagement flaps (22) of the screw cap (20).

5. In a closure in accordance with claim 4, wherein the engagement flaps (22) have thin walls and extend over a portion of the circumference of the cap shell (21) and are radially displaceable.

6. In a closure in accordance with claim 1, wherein two engagement flaps (22) are disposed diametrically on the cap shell (21), and one said engagement cam (23) is associated with each said engagement flap (22) on the lower closure part (10).

7. In a closure in accordance with claim 1, wherein the pouring spout (15) makes a transition through a shoulder (13) into an elastically extendible body (12), and the annular flange (14) at the shoulder (13) is formed concentrically in respect to the pouring spout (15) and with said pouring spout (15) forms an annular receptacle (26) for the at least one engagement flap (22) of the screw cap (20).

8. In a closure in accordance with claim 1, wherein the at least one engagement flap (22) has a wall and extends over a portion of the circumference of the cap shell (21) and is radially displaceable.

* * * * *

UNITED STATES PATENT AND TRADEMARK OFFICE

CERTIFICATE OF CORRECTION

PATENT NO. : 5,526,947

DATED : 18 June 1996

INVENTOR(S) : Bernd STOLZ

It is certified that error appears in the above—identified patent and that said Letters Patent is hereby corrected as shown below:

On the title page: Item [22]

Delete the filing date and in its place insert:

—Filed: January 4, 1995—

Signed and Sealed this

Fifteenth Day of October, 1996

*Attest:*

*Attesting Officer*

BRUCE LEHMAN

*Commissioner of Patents and Trademarks*